US009331448B2

(12) United States Patent
Jeon et al.

(10) Patent No.: US 9,331,448 B2
(45) Date of Patent: May 3, 2016

(54) ELECTRICAL CONNECTOR HAVING PRIMARY AND SECONDARY LEADFRAMES

(71) Applicant: Tyco Electronics Corporation, Berwyn, PA (US)

(72) Inventors: James Myoungsoo Jeon, Harrisburg, PA (US); Chad William Morgan, Carneys Point, NJ (US); Craig Warren Hornung, Harrisburg, PA (US); Michael Joseph Vino, IV, Landisville, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 234 days.

(21) Appl. No.: 14/225,100

(22) Filed: Mar. 25, 2014

(65) Prior Publication Data

US 2015/0280380 A1 Oct. 1, 2015

(51) Int. Cl.
*H01R 43/24* (2006.01)
*H01R 13/6587* (2011.01)

(52) U.S. Cl.
CPC ..... *H01R 43/24* (2013.01); *H01R 13/6587* (2013.01)

(58) Field of Classification Search
CPC ..... H01R 43/24
See application file for complete search history.

(56) References Cited

U.S. PATENT DOCUMENTS 5,274,918 A * 1/1994 Reed ..... H01R 29/00 264/263
6,402,560 B1 * 6/2002 Lin ..... H01R 13/6464 439/676
6,722,926 B2 * 4/2004 Chevassus-More ... H02G 5/005 439/721
9,124,045 B2 * 9/2015 Shiratori ..... H01R 23/02
9,190,756 B2 * 11/2015 Glick ..... H01R 13/113
2006/0189222 A1 * 8/2006 Bogiel ..... H01R 12/724 439/884
2008/0224814 A1 * 9/2008 Pavlovic ..... H01H 85/08 337/164
2012/0018187 A1 1/2012 Berchtold
2013/0231009 A1 9/2013 Jeon et al.
2014/0111960 A1 * 4/2014 Laub ..... H01R 13/6585 361/813
2014/0227915 A1 * 8/2014 Glick ..... H01R 13/113 439/856
2014/0357133 A1 * 12/2014 Drijfhout ..... H01R 13/504 439/701
2015/0280380 A1 * 10/2015 Jeon ..... H01R 43/24 439/682
2015/0325954 A1 * 11/2015 Malervy ..... H01R 13/6461 174/359

* cited by examiner

*Primary Examiner* — James Harvey

(57) ABSTRACT

An electrical connector includes a contact module including a leadframe assembly and a dielectric frame overmolded on the leadframe assembly. The leadframe assembly includes a primary leadframe having signal conductors with transition contacts encased in the dielectric frame. At least some of the signal conductors have mating contacts extending from corresponding transition contacts configured to be electrically connected to corresponding signal contacts of a mating connector. The leadframe assembly includes a secondary leadframe is mechanically and electrically connected to the primary leadframe. The secondary leadframe has mounting segments connected to corresponding signal conductors of the primary leadframe. The secondary leadframe has mating contacts extending from corresponding mounting segments configured to be electrically connected to corresponding signal contacts of the mating connector. The secondary leadframe may be welded to the primary leadframe.

20 Claims, 7 Drawing Sheets

ELECTRICAL CONNECTOR HAVING PRIMARY AND SECONDARY LEADFRAMES

BACKGROUND OF THE INVENTION

The subject matter herein relates generally to an electrical connector having contacts formed on a leadframe.

Electrical systems, such as those used in networking and telecommunication systems, utilize electrical connectors to interconnect components of the system, such as a motherboard and daughtercard. However, as speed and performance demands increase, known electrical connectors are proving to be insufficient. Signal loss and/or signal degradation is a problem in known electrical systems. Additionally, there is a desire to increase the density of electrical connectors to increase throughput of the electrical system, without an appreciable increase in size of the electrical connectors, and in some cases, with a decrease in size of the electrical connectors. Such increase in density and/or reduction in size causes further strains on performance.

In order to address performance, some known systems utilize shielding to reduce interference between the contacts of the electrical connectors. Additionally, some known system use contacts that have redundant or multiple points of contact. Such contacts require a large amount of material when stamping and forming the contact. Due to the tight spacing or pitch of the contacts, there is simply not enough material in the blank to form all of the contacts with the desired shape. Some known designs to overcome the problem of insufficient material to form the contacts utilize two dielectric overmolded pieces that are internested to form the contact modules of the electrical connector. Such designs are expensive and complicated.

A need remains for an electrical connector that may be manufactured in a cost effective and reliable manner.

BRIEF DESCRIPTION OF THE INVENTION

In one embodiment, an electrical connector is provided that includes a contact module including a leadframe assembly and a dielectric frame overmolded on the leadframe assembly. The leadframe assembly includes a primary leadframe having signal conductors. The signal conductors have transition contacts encased in the dielectric frame. At least some of the signal conductors have mating contacts extending from corresponding transition contacts configured to be electrically connected to corresponding signal contacts of a mating connector. A secondary leadframe is mechanically and electrically connected to the primary leadframe. The secondary leadframe has mounting segments connected to corresponding signal conductors of the primary leadframe. The secondary leadframe has mating contacts extending from corresponding mounting segments configured to be electrically connected to corresponding signal contacts of the mating connector. The mating contacts of the secondary leadframe define portions of the signal conductors when the secondary leadframe is connected to the primary leadframe.

Optionally, the secondary leadframe may be welded to the primary leadframe. The mounting segments may be terminated to corresponding signal conductors of the primary leadframe and then overmolded by the dielectric frame. The signal conductors may be arranged as differential pairs. One of the signal conductors of each differential pair may include a corresponding mating contact of the primary leadframe and the other signal conductor of the differential pair may include a corresponding mating contact of the secondary leadframe.

In another embodiment, an electrical connector is provided that includes a primary leadframe and a secondary leadframe mechanically and electrically connected to the primary leadframe. The primary leadframe includes signal conductors arranged as differential pairs and a carrier holding each of the signal conductors. The carrier has connecting strips between each of the signal conductors to hold the relative positions of the signal conductors for overmolding, such connecting strips being configured to be later removed after the signal conductors are overmolded. The signal conductors have transition contacts configured to be encased in the dielectric frame. The signal conductors have residual sections forward of the transition contacts where the connecting strips connect residual sections of adjacent signal conductors. The residual sections are configured to remain after the connecting strips are removed. At least some of the signal conductors having mating contacts extending forward from corresponding residual sections. The mating contacts of the primary leadframe are configured to be electrically connected to corresponding signal contacts of a mating connector. The secondary leadframe has a carrier configured to be coupled to the carrier of the primary leadframe. The secondary leadframe has mounting segments mechanically and electrically connected to corresponding signal conductors of the primary leadframe. The secondary leadframe has connecting strips between each of the mounting segments to hold the relative positions of the mounting segments for positioning over the primary leadframe and for overmolding. The connecting strips of the secondary leadframe are configured to be later removed after the mounting segments are overmolded. The secondary leadframe has mating contacts extending from corresponding mounting segments configured to be electrically connected to corresponding signal contacts of the mating connector.

In a further embodiment, an electrical connector is provided that includes a front housing and a plurality of contact modules coupled to the front housing. Each contact module includes a conductive holder having a front coupled to the front housing and a bottom configured to be mounted to a circuit board. The conductive holder has a chamber including a plurality of channels extending between the front and the bottom. A contact assembly is received in the chamber. The contact assembly includes a leadframe assembly and a dielectric frame holding the leadframe assembly. The leadframe assembly includes a primary leadframe and a secondary leadframe. The primary leadframe has signal conductors arranged as differential pairs, the signal conductors having transition contacts extending between the front and the bottom. The dielectric frame has frame members supporting corresponding transition contacts. The transition contacts are routed through corresponding channels. The signal conductors include mounting contacts extending from the bottom of the conductive holder for electrical termination to the circuit board. At least some of the signal conductors have mating contacts extending from corresponding transition contacts forward of the front of the conductive holder. The mating contacts of the primary leadframe are configured to be electrically connected to corresponding signal contacts of a mating connector. The secondary leadframe is mechanically and electrically connected to the primary leadframe. The secondary leadframe has mounting segments terminated to corresponding signal conductors of the primary leadframe. The secondary leadframe has mating contacts extending from corresponding mounting segments forward of the front of the conductive holder. The mating contacts of the secondary leadframe are configured to be electrically connected to corresponding signal contacts of the mating connector.

DETAILED DESCRIPTION OF THE INVENTION

Figure 1:
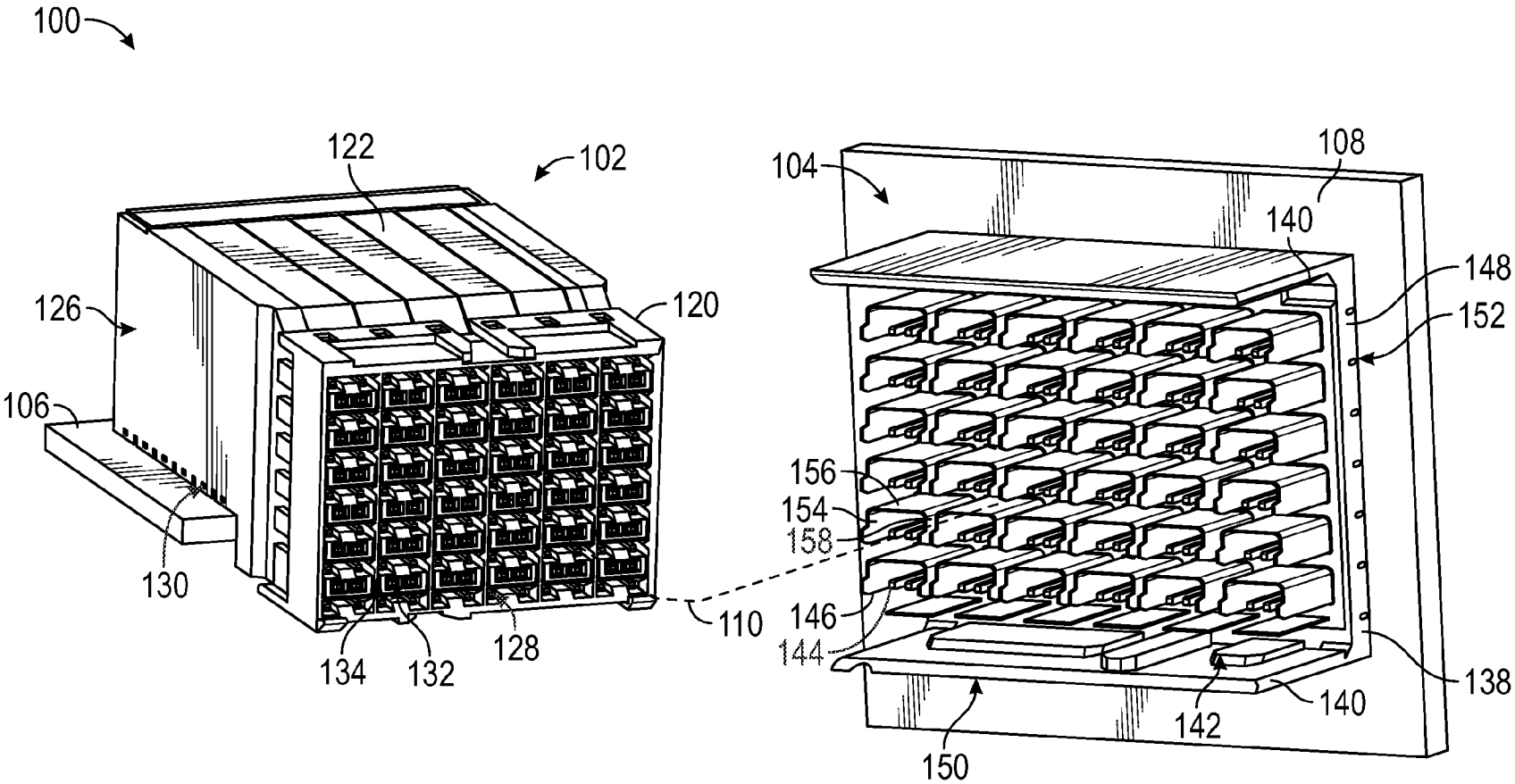
FIG. 1 is a perspective view of an electrical connector system 100 illustrating an electrical connector and a mating connector.

FIG. 1 is a perspective view of an exemplary embodiment of an electrical connector system 100 illustrating an electrical connector 102 and a mating connector 104 that may be directly mated together. The connectors 102, 104 are mated together along a mating axis 110. The electrical connector 102 and the mating connector 104 may be a receptacle connector and a header connector and may be referred to hereinafter as a receptacle connector 102 and a header connector 104, respectively. The connectors 102, 104 may be any type of connector in alternative embodiments.

The receptacle and header connectors 102, 104 are each electrically connected to respective circuit boards 106, 108. The receptacle and header connectors 102, 104 are utilized to electrically connect the circuit boards 106, 108 to one another at a separable mating interface. In an exemplary embodiment, the circuit boards 106, 108 are oriented perpendicular to one another when the receptacle and header connectors 102, 104 are mated. Alternative orientations of the circuit boards 106, 108 are possible in alternative embodiments. In other alternative embodiments, either or both of the connectors 102, 104 may be cable connectors terminated to ends of cables rather than being board connectors terminated to the circuit boards 106, 108.

The receptacle connector 102 includes a front housing 120 that holds a plurality of contact modules 122. Any number of contact modules 122 may be provided to increase the density of the receptacle connector 102. The contact modules 122 may be identical to each other. Alternatively, different types of contact modules, referred to as end contact modules, may be provided at the ends. The end contact modules may have slightly different features as such end contact modules define the exterior sides of the receptacle connector 102.

The contact modules 122 each include a plurality of signal conductors 124 (shown in FIG. 2) that are received in the front housing 120 for mating with the header connector 104. Optionally, the signal conductors 124 may be arranged as differential pairs, with the signal conductors of each pair being within the same contact module 122.

In an exemplary embodiment, each contact module 122 has a shield structure 126 for providing electrical shielding for the signal conductors 124. The shield structure 126 may include multiple components, electrically interconnected, which provide the electrical shielding. Optionally, the shield structure 126 may provide electrical shielding for differential pairs of the signal conductors 124 to shield the differential pairs from one another. In an exemplary embodiment, the shield structure 126 is electrically connected to the header connector 104 and/or the circuit board 106. For example, the shield structure 126 may be electrically connected to the header connector 104 by extensions (for example, beams, contacts or fingers) provided at the front of the contact modules 122 that engage the header connector 104. Optionally, as in the embodiments illustrated herein, the extensions may extend from the contact modules 122. The shield structure 126 may be electrically connected to the circuit board 106 by features, such as ground pins. In alternative embodiments, the contact modules 122 may be un-shielded.

The receptacle connector 102 includes a mating end 128 and a mounting end 130. Optionally, the mounting end 130 may be substantially perpendicular to the mating end 128. The signal conductors 124 are received in the front housing 120 and held therein at the mating end 128 for mating to the header connector 104. The signal conductors 124 are arranged in rows and columns at the mating end 128. Any number of signal conductors 124 may be provided in the rows and columns. In an exemplary embodiment, the signal conductors 124 within a differential pair are arranged in a same row at the mating end 128. The signal conductors 124 also extend to the mounting end 130 for mounting to the circuit board 106.

The front housing 120 is manufactured from a dielectric material, such as a plastic material, and is designed to hold the contact modules 122 in a stacked configuration. The front housing 120 includes a plurality of signal contact openings 132 and a plurality of ground contact openings 134 at the mating end 128. The signal conductors 124 are aligned with corresponding signal contact openings 132. The signal contact openings 132 receive corresponding header signal contacts 144 therein when the receptacle and header connectors 102, 104 are mated. The ground contact openings 134 receive header ground shields 146 therein when the receptacle and header connectors 102, 104 are mated.

The header connector 104 includes a header housing 138 having walls 140 defining a chamber 142. The header connector 104 has a mating end 150 and a mounting end 152 that is mounted to the circuit board 108. Optionally, the mounting end 152 may be substantially parallel to the mating end 150. The receptacle connector 102 is received in the chamber 142 through the mating end 150. The front housing 120 engages the walls 140 to hold the receptacle connector 102 in the chamber 142. The header signal contacts 144 and the header ground shields 146 extend from a base wall 148 into the chamber 142. The header signal contacts 144 and the header ground shields 146 extend through the base wall 148 and are mounted to the circuit board 108.

In an exemplary embodiment, the header signal contacts 144 are arranged as differential pairs. The header ground shields 146 are positioned between the differential pairs to provide electrical shielding between adjacent differential pairs. The header ground shields 146 have a plurality of walls, such as three planar walls 154, 156, 158. The walls 154, 156, 158 may be integrally formed or alternatively, may be separate pieces. In the illustrated embodiment, the header ground shields 146 are C-shaped and provide shielding on three sides of the pair of header signal contacts 144. The wall 156 defines a center wall or top wall of the header ground shield 146. The walls 154, 158 define side walls that extend from the center wall 156. The header ground shield 146 associated with an adjacent pair of header signal contacts 144 provides shielding along the open, fourth side of the header ground shield 146 such that each of the pairs of signal contacts 144 is shielded from each adjacent pair in the same column and the same row. For example, the top wall 156 of a first header ground shield 146 which is below a second header ground shield 146 provides shielding across the open bottom of the C-shaped second header ground shield 146. Other configurations or shapes for the header ground shields 146 are possible in alternative embodiments. More or less walls may be provided in alternative embodiments. The walls may be bent or angled rather than being planar. In other alternative embodiments, the header ground shields 146 may provide shielding for individual signal contacts 144 or sets of contacts having more than two signal contacts 144.

Figure 2:
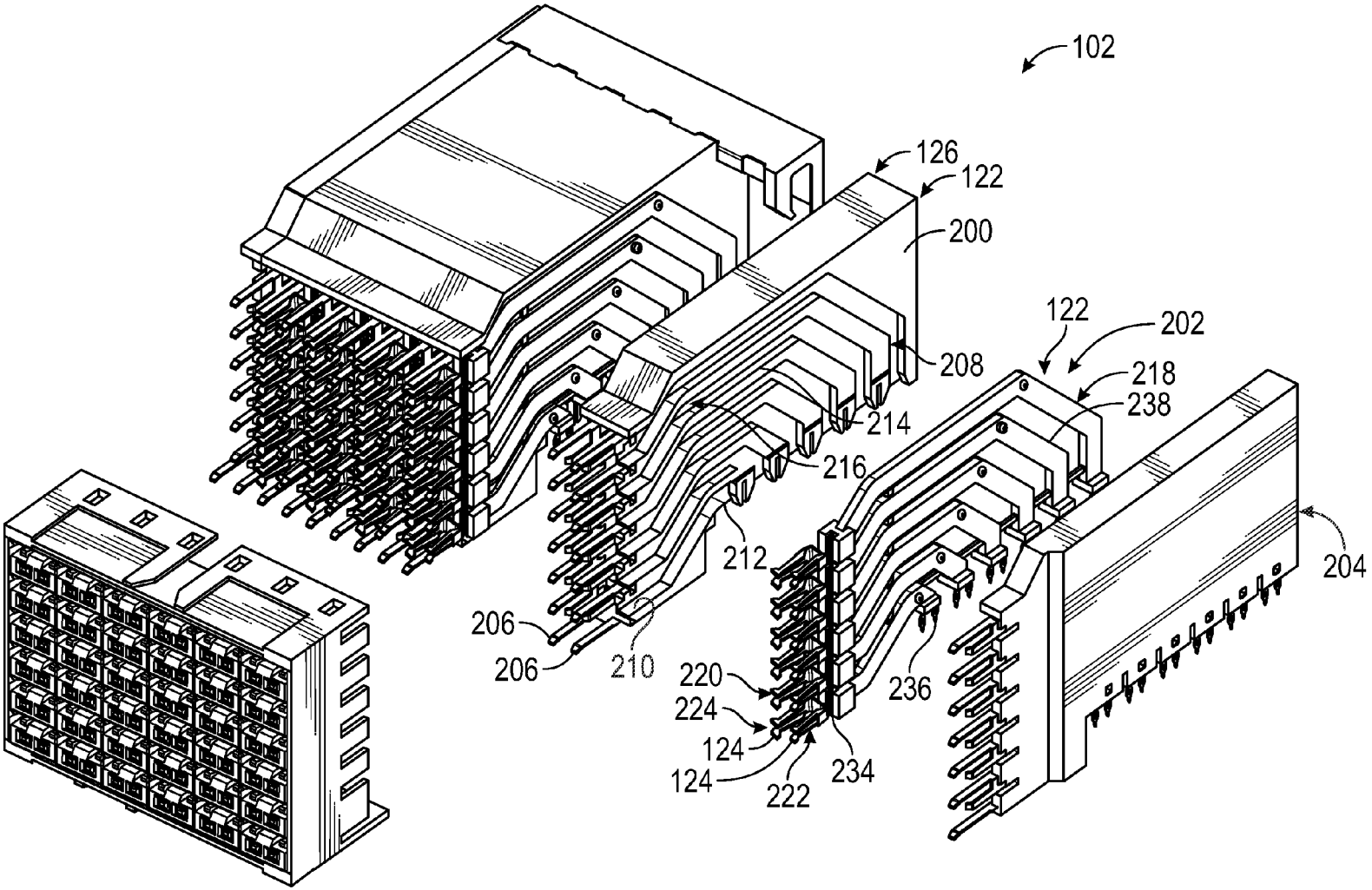
FIG. 2 is an exploded view of a contact module for the electrical connector.

FIG. 2 is an exploded view of one of the contact modules 122. The contact module 122 includes a holder 200 and a contact assembly 202 held by the holder 200. The signal conductors 124 are part of the contact assembly 202. The shield structure 126 provides electrical shielding for the contact assembly 202. The shield structure 126 may include the holder 200. The shield structure 126 includes a ground shield 204 and a plurality of ground contacts 206 electrically connected to the ground shield 204. The ground shield 204 and ground contacts 206 electrically connect the contact module 122 to the header ground shields 146 (shown in FIG. 1). The ground shield 204 and ground contacts 206 provide multiple, redundant points of contact to the header shield 146. The ground shield 204 and ground contacts 206 provide shielding on all sides of the signal conductors 124. In alternative embodiments, the ground contacts 206 may be part of the ground shield 204 rather than being separate components. Optionally, ground shields 204 may be provided on both sides of the contact module 122 rather than on a single side.

In an exemplary embodiment, the holder 200 is conductive and defines at least a portion of the shield structure 126 of the receptacle connector 102. For example, the holder 200 may be die-cast from a metal material. Alternatively, the holder 200 may be stamped and formed or may be fabricated from a plastic material that has been metalized or coated with a metallic layer. By having the holder 200 fabricated from a conductive material, the holder 200 may provide electrical shielding for the receptacle connector 102. The holder 200 may be a single piece, or alternatively, may be a multiple-piece holder (for example, two mating halves).

The holder 200 includes a chamber 208 that receives the contact assembly 202. The chamber 208 extends between a front 210 and a bottom 212 of the holder 200; however the chamber 208 may extend to other areas of the holder 200, such as the rear or the top. The holder 200 includes tabs 214 that divide the chamber 208 into discrete channels 216. The contact assembly 202 is loaded into the chamber 208 such that the tabs 214 extend through the contact assembly 202 between adjacent pairs of signal conductors 124. The tabs 214 define at least a portion of the shield structure 126 of the receptacle connector 102 and provide shielding between the channels 216. The tabs 214 thus provide shielding between the pairs of signal conductors 124 held in the different channels 216.

The holder 200 provides shielding around the signal conductors 124 of the contact assembly 202. For example, the holder 200, which is part of the shield structure 126, provides electrical shielding between and around respective signal conductors 124. The holder 200 provides shielding from electromagnetic interference (EMI) and/or radio frequency interference (RFI). The holder 200 may provide electrical shielding from other types of interference as well. The holder 200 provides shielding around the outside of the contact assembly 202, and thus around the outside of all of the signal conductors 124, as well as between the signal conductors 124, such as between pairs of signal conductors 124.

The contact assembly 202 includes a dielectric frame 218 and a leadframe assembly 220 including a primary leadframe 222 and a secondary leadframe 224. The primary and secondary leadframes 222, 224 define the signal conductors 124. The primary and secondary leadframes 222, 224 are overmolded with dielectric material to form the dielectric frame 218. In an exemplary embodiment, the primary and secondary leadframes 222, 224 are separately manufactured, such as being stamped and formed leadframes 222, 224. The secondary leadframe 224 is mechanically and electrically connected to the primary leadframe 222 prior to overmolding of the dielectric frame 218. For example, the secondary leadframe 224 may be welded to the primary leadframe 222 and then portions of both leadframes 222, 224 are overmolded by the dielectric frame 218. By separately manufacturing the primary and secondary leadframes 222, 224, the mating contacts at the mating ends of the signal conductors 124 can be robustly manufactured and provided at a tight spacing or pitch. For example, a single leadframe design may not be possible or practical due to the large amount of material needed to form the mating contacts of the signal conductors 124. Rather than providing and nesting two completely separate contact assemblies, the contact assembly 202 mechanically and electrically connects the secondary leadframe 224 to the primary leadframe 222 prior to overmolding of the dielectric frame 218. A simple and inexpensive contact assembly 202 is formed in such manner, while still providing high density and robust mating contacts at the mating ends of the signal conductors 124.

The dielectric frame 218 includes a front wall 234 and a bottom wall 236. The dielectric frame 218 includes a plurality of frame members 238. The frame members 238 hold respective pairs of the signal conductors 124. For example, each pair of signal conductors 124 extends along, and inside of, a corresponding frame member 238. The frame members 238 encase the pairs of signal conductors 124. In an exemplary embodiment, the dielectric frame 218 encases portions of both the primary and secondary leadframes 222, 224. The tabs 214 are configured to extend through the dielectric frame 218, such as between respective frame members 238 to provide shielding between corresponding pairs of signal conductors 124.

Figure 3:
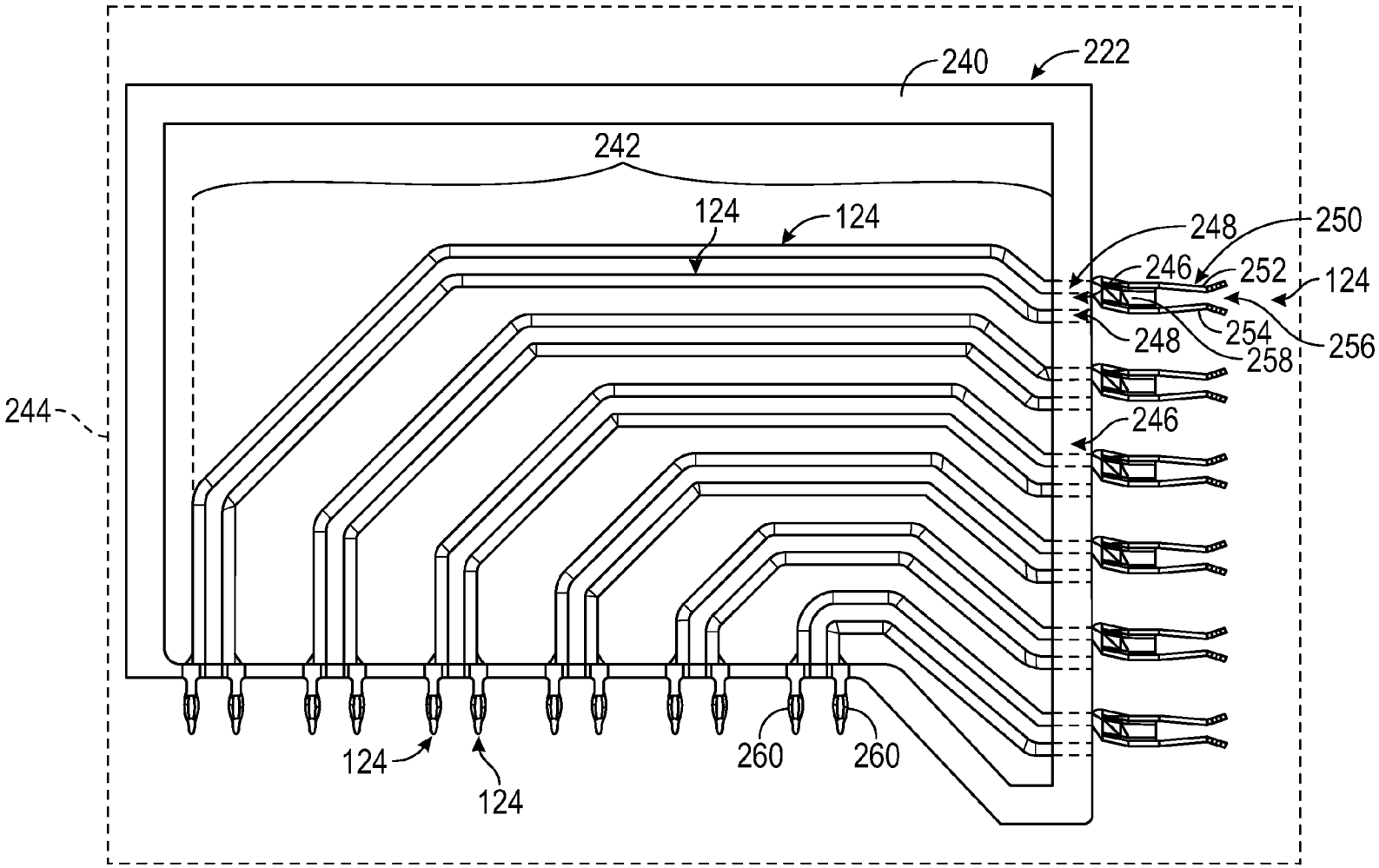
FIG. 3 is a perspective view of a primary leadframe of the contact module.

FIG. 3 is a perspective view of the primary leadframe 222. The primary leadframe 222 is a stamped and formed leadframe that is stamped from a blank or sheet of metal material, formed into a predetermined shape, and may be selectively plated, such as in interface areas. The primary leadframe 222 defines portions of the signal conductors 124.

The primary leadframe 222 is initially stamped with a carrier 240, which is later removed after the dielectric frame 218 (shown in FIG. 2) is overmolded over transition contacts 242 of the primary leadframe 222. In an exemplary embodiment, the transition contacts 242 are arranged in pairs, with the transition contacts 242 of each pair more closely positioned relative to one another than to the transition contacts 242 of another pair. Other arrangements are possible in alternative embodiments.

The carrier 240 and transition contacts 242 define a contact plane 244 of the primary leadframe 222. The majority of the segments of the signal conductors 124 lie in the contact plane 244. Optionally, some segments of the signal conductors 124 may be formed and extend out of the contact plane 244.

The carrier 240 includes connecting strips 246 between the transition contacts 242 used to hold the relative positions of the transition contacts 242 for overmolding. The connecting strips 246 are removed after the transition contacts 242 are overmolded, which leave behind residual sections 248. The residual sections 248 remain after the connecting strips 246 are removed. The residual sections 248 form part of the signal conductors 124.

The primary leadframe 222 includes mating contacts 250 extending forward of the transition contacts 242. The mating contacts 250 are configured to be mated with corresponding header signal contacts 144 (shown in FIG. 1). The residual sections 248 are positioned between the mating contacts 250 and the transition contacts 242. The residual sections 248 may define at least portions of the transition contacts 242 and/or the mating contacts 250. In an exemplary embodiment, the mating contacts 250 are bent out of the contact plane 244, such as to one side of the contact plane 244.

In an exemplary embodiment, the mating contacts 250 are split-beam mating contacts having first and second beams 252, 254 defining a receptacle or socket 256 configured to receive the header signal contact 144. The first and second beams 252, 254 are configured to engage opposite sides of the header signal contact 144. The first and second beams 252, 254 define multiple points of contact with the header signal contact 144 to define a reliable electrical connection between the mating contact 250 and the header signal contact 144. During manufacture, the first and second beams 252, 254 are stamped out of the blank of material with a base section 258 and then folded or formed perpendicular to the base section 258. Such a structure requires a large amount of material of the blank to form the base section 258 and the first and second beams 252, 254. In order to maintain the tight spacing or pitch between all of the signal conductors 124, the primary leadframe 222 is used to form some of the signal conductors 124, while the secondary leadframe 224 (shown in FIG. 1) is used to form the rest of the signal conductors 124, as will be described in further detail below. For example, the mating contacts 250 of the primary leadframe 222 are associated with only one of the transition contacts 242 of each pair, such as the upper or outer transition contact 242 of each pair.

The primary leadframe 222 includes mounting contacts 260 extending from an end of the transition contacts 242 opposite from the mating contacts 250. The mounting contacts 260 are configured to be mated with the circuit board 106 (shown in FIG. 1). In the illustrated embodiment, the mounting contacts 260 are compliant pins, such as eye-of-the-needle pins, that are configured to be press-fit into the circuit board 106. Other types of contacts may be provided in alternative embodiments, such as solder pins, solder tails, solder pads, spring tails and the like. In other embodiments, the mounting contacts 260 may be configured to be terminated to cables rather than to the circuit board 106, such as by crimping, soldering, or otherwise terminating to the cables.

The carrier 240 connects the transition contacts 242 proximate to the mounting contacts 260 to hold the relative positions of the mounting contacts 260, such as for mounting to the circuit board 106. Optionally, the mounting contacts 260 may be in the contact plane 244. In the illustrated embodiments, the transition contacts 242 transition 90° between the mating contacts 250 and the mounting contacts 260 such that the mating contacts 250 are generally perpendicular to the mounting contacts 260. Other configurations are possible in alternative embodiments.

Figure 4:
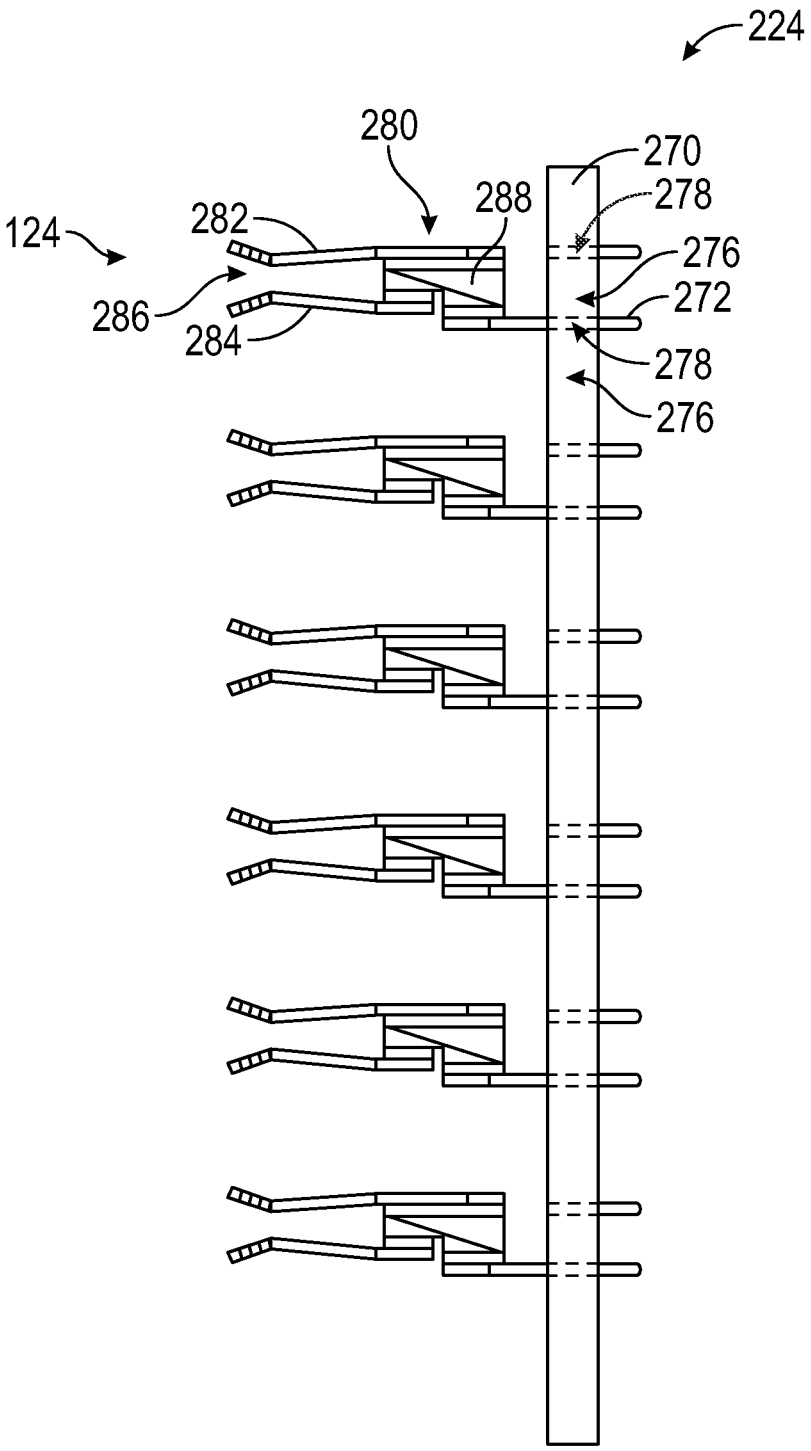
FIG. 4 is a perspective view of the secondary leadframe of the contact module.

FIG. 4 is a perspective view of the secondary leadframe 224. The secondary leadframe 224 is a stamped and formed leadframe that is stamped from a blank or sheet of metal material, formed into a predetermined shape, and may be selectively plated, such as in interface areas. The secondary leadframe 224 is configured to be mechanically and electrically connected to the primary leadframe 222 (shown in FIG. 3) to define portions of the signal conductors 124.

The secondary leadframe 224 is initially stamped with a carrier 270, which is later removed after the dielectric frame 218 (shown in FIG. 2) is overmolded over the primary and secondary leadframes 222, 224. The secondary leadframe 224 includes mounting segments 272 that are configured to be mounted to the primary leadframe 222, such as to corresponding transition contacts 242 (shown in FIG. 3). Optionally, at least portions of the mounting segments 272 may be overmolded by the dielectric frame 218.

The carrier 270 includes connecting strips 276 between the mounting segments 272 used to hold the relative positions of the mounting segments 272 for positioning relative to the primary leadframe 222 for termination thereto. The connecting strips 276 are removed after the mounting segments 272 are overmolded, which leave behind residual sections 278. The residual sections 278 remain after the connecting strips 276 are removed. The residual sections 278 form part of the signal conductors 124.

The secondary leadframe 224 includes mating contacts 280 extending forward of the mounting segments 272. The mating contacts 280 are configured to be mated with corresponding header signal contacts 144 (shown in FIG. 1). The residual sections 278 are positioned between the mating contacts 280 and the mounting segments 272. The residual sections 278 may define at least portions of the mounting segments 272 and/or the mating contacts 280. In an exemplary embodiment, the mating contacts 280 are bent out of the plane of the mounting segments 272.

In an exemplary embodiment, the mating contacts 280 are similar to the mating contacts 250 (shown in FIG. 3). The mating contacts 280 are split-beam mating contacts having first and second beams 282, 284 defining a receptacle or socket 286 configured to receive the header signal contact 144. During manufacture, the first and second beams 282, 284 are stamped out of the blank of material with a base section 288, and then folded or formed perpendicular to the base section 288. Such a structure requires a large amount of material of the blank to form the base section 288 and the first and second beams 282, 284. In order to maintain the tight spacing or pitch between all of the signal conductors 124, the secondary leadframe 224 is used to form some of the signal conductors 124, while the primary leadframe 222 is used to form the rest of the signal conductors 124.

Figure 5:
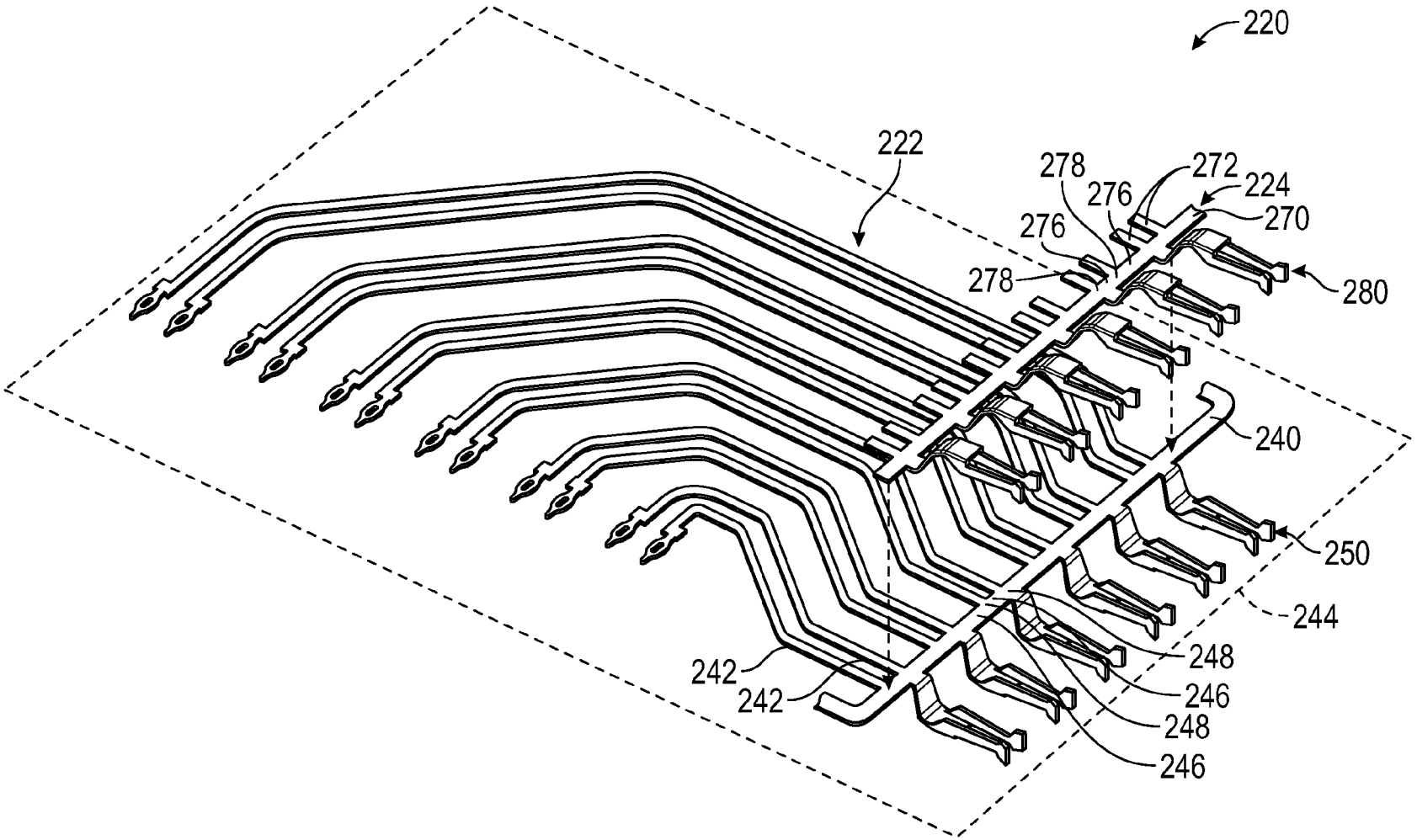
FIG. 5 illustrates the secondary leadframe being coupled to the primary leadframe to form a leadframe assembly.

FIG. 5 illustrates the secondary leadframe 224 being coupled to the primary leadframe 222 to form the leadframe assembly 220. After the primary and secondary leadframes 222, 224 are stamped and formed, the secondary leadframe 224 is positioned along one side of the primary leadframe 222.

The mounting segments 272 of the secondary leadframe 224 are aligned with the corresponding transition contacts 242 of the primary leadframe 222. The carrier 270 of the secondary leadframe 224 is aligned with a corresponding section of the carrier 240 of the primary leadframe 222. The connecting strips 276 of the secondary leadframe 224 are aligned with corresponding connecting strips 246 of the primary leadframe 222. The residual sections 278 of the secondary leadframe 224 are aligned with corresponding residual sections 248 of the primary leadframe 222. In an alternative embodiment, rather than having all of the transition contacts 242 as part of the primary leadframe 222, both the primary and secondary leadframes 222, 224 may include transition contacts 242, which may be associated with corresponding mating contacts 250, 280. In such embodiments, the primary leadframe 222 may include mounting segments, similar to the mounting segments 272, which are connected (for example, welded) to corresponding transition contacts of the secondary leadframe 224.

The mating contacts 280 of the secondary leadframe 224 are aligned with the corresponding mating contacts 250 of the primary leadframe 222, with the mating contacts 280 being bent and transitioning to one side of the contact plane 244 and with the mating contacts 250 being bent and transitioning to the other side of the contact plane 244.

Figure 6:
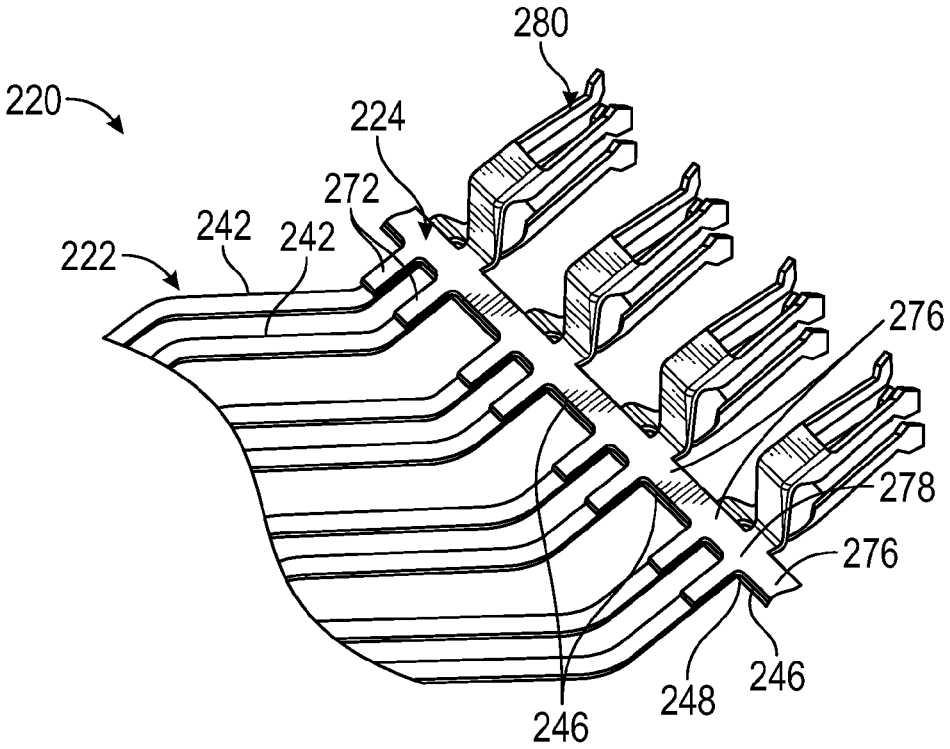
FIG. 6 illustrates a portion of the leadframe assembly.

FIG. 6 illustrates a portion of the leadframe assembly 220 showing the secondary leadframe 224 mechanically and electrically coupled to the primary leadframe 222. In an exemplary embodiment, the secondary leadframe 224 is welded to the primary leadframe 222; however the secondary leadframe 224 may be mechanically and electrically coupled to the primary leadframe 222 by other means or processes in alternative embodiments, such as by soldering, using conductive epoxy, using fasteners, and the like. The connecting strips 246, 276 and the residual sections 248, 278 form an overmold dam which blocks the overmold material from flowing forward when the dielectric frame 218 (FIG. 2) is overmolded on the leadframe assembly 220. All of the connecting strips 246, 276 will be removed from the leadframe assembly 220 after the overmolding operation.

The mounting segments 272 of the secondary leadframe 224 extend along the corresponding transition contacts 242 of the primary leadframe 222. In an exemplary embodiment, the mounting segments 272 are welded to the transition contacts 242. Optionally, every transition contact 242 includes a corresponding mounting segment welded thereto. The mounting segments 272 may only extend a short distance along the transition contacts 242, such as a sufficient length for mechanically and electrically coupling thereto. Optionally, the residual sections 278 of the secondary leadframe 224 may be welded to, or otherwise connected to, the corresponding residual sections 248 of the primary leadframe 222 in additional to, or in lieu of, the mounting segments 272.

By mechanically and electrically coupling the secondary leadframe 224 to the primary leadframe 222, the contact module 122 (shown in FIG. 2) includes transmission lines defined along the mating contact 280 of the secondary leadframe 224 to the mounting segments 272 of the secondary leadframe 224 to the corresponding transition contacts 242 of the primary leadframe 222. The transition contacts 242 of the primary leadframe 222 electrically connect the mounting segments 272 of the secondary leadframe 224 with corresponding mounting contacts 260 (shown in FIG. 3) of the primary leadframe 222.

Figure 7:
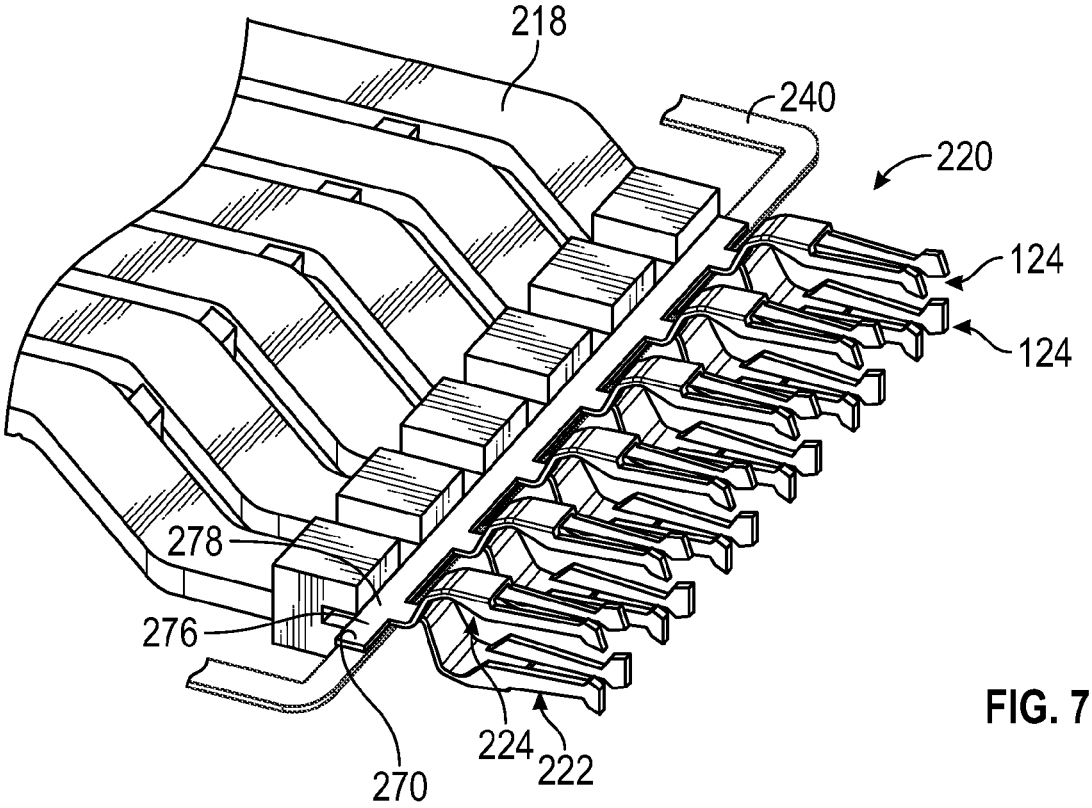
FIG. 7 illustrates a portion of the leadframe assembly and dielectric frame of the contact module.

FIG. 7 illustrates a portion of the leadframe assembly 220 and dielectric frame 218 overmolded over the primary and secondary leadframes 222, 224. The carriers 240, 270 remain intact during the overmolding process to hold the relative positions of the signal conductors 124. The overmold material abuts against the dam formed by the connecting strips 246, 276 (246 is shown in FIG. 6) and the residual sections 248, 278 (248 is shown in FIG. 6). The transition contacts 242 and mounting segments 272 (both shown in FIG. 6) are encased in the overmold material forming the dielectric frame 218. In an exemplary embodiment, the dielectric frame 218 is a unitary one piece dielectric body overmolded over the transition contacts 242 of the primary leadframe 222 and the mounting segments 272 of the secondary leadframe 224.

Figure 8:
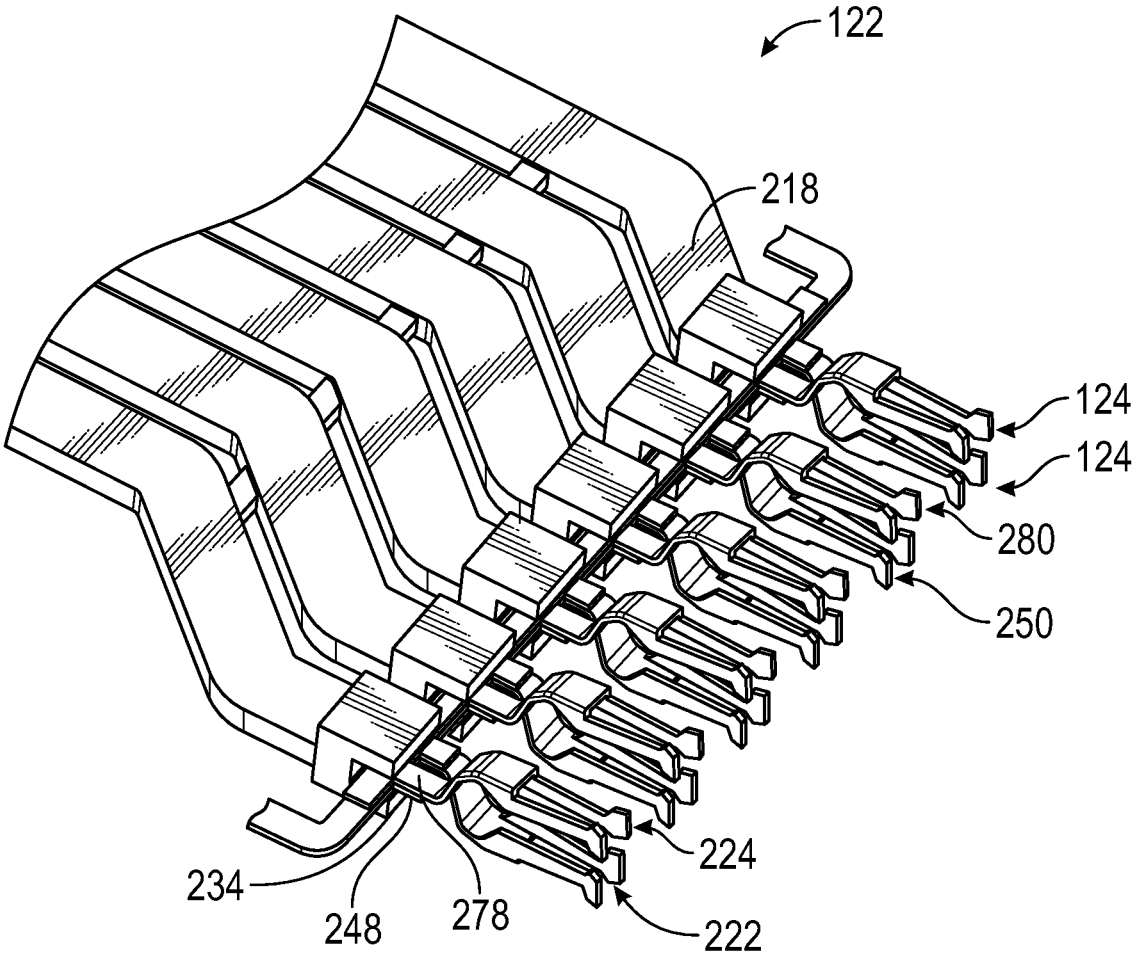
FIG. 8 illustrates a portion of the contact module.

FIG. 8 illustrates a portion of the contact module 122 with the carriers 240, 270 (shown in FIG. 7) removed. The connecting strips 246, 276 (both shown in FIG. 6) have been removed, leaving the residual sections 248, 278 in place forward of the front wall 234 of the dielectric frame 218. The transition contacts 242 and mounting segments 272 (both shown in FIG. 6) remain encased in the dielectric frame 218.

The mating contacts 250, 280 extend forward of the front wall 234 for mating with the corresponding header signal contacts 144 (shown in FIG. 1). The mating contacts 250, 280 are aligned with each other in pairs corresponding to the differential pairs of signal conductors 124. The pairs of mating contacts 250, 280 are aligned in rows at the front of the contact module 122. One of the signal conductors 124 of each differential pair includes a corresponding mating contact 250 of the primary leadframe 222 and the other signal conductor 124 of the differential pair includes a corresponding mating contact 280 of the secondary leadframe 224. The mating contacts 250 of the primary leadframe 222 are bent out of the contact plane 244 (shown in FIG. 2) to a first side of the primary leadframe 222. The mating contacts 280 of the secondary leadframe 224 are bent out of the contact plane 244 to a second side of the primary leadframe 222.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f) unless and until such claim limitations expressly use the phrase "means for" followed by a statement of function void of further structure.

What is claimed is:

1. An electrical connector comprising:

a contact module including a leadframe assembly and a dielectric frame overmolded on the leadframe assembly;

the leadframe assembly including a primary leadframe having signal conductors, the signal conductors having transition contacts encased in the dielectric frame, at least some of the signal conductors having mating contacts extending from corresponding transition contacts and configured to be electrically connected to corresponding signal contacts of a mating connector; and the leadframe assembly including a secondary leadframe mechanically and electrically connected to the primary leadframe, the secondary leadframe having mounting segments connected to corresponding signal conductors of the primary leadframe, the secondary leadframe having mating contacts extending from corresponding mounting segments configured to be electrically connected to corresponding signal contacts of the mating connector, the mating contacts of the secondary leadframe defining portions of the signal conductors when the secondary leadframe is connected to the primary leadframe.

2. The electrical connector of claim 1, wherein the secondary leadframe is welded to the primary leadframe.

3. The electrical connector of claim 1, wherein the mounting segments are encased in the dielectric frame.

4. The electrical connector of claim 1, wherein the signal conductors are associated as differential pairs, one of the signal conductors of each differential pair includes a corresponding mating contact of the primary leadframe and the other signal conductor of the differential pair includes a corresponding mating contact of the secondary leadframe.

5. The electrical connector of claim 1, wherein the signal conductors include mounting contacts extending from the dielectric frame for termination to a circuit board, the transition contacts of the primary leadframe electrically connecting the mounting segments of the secondary leadframe with corresponding mounting contacts of the primary leadframe.

6. The electrical connector of claim 1, wherein the mating contacts of the primary leadframe are aligned with corresponding mating contacts of the secondary leadframe of the same differential pair in rows.

7. The electrical connector of claim 1, wherein the transition contacts are arranged within a contact plane of the primary leadframe, the mating contacts of the primary leadframe being bent out of the contact plane to a first side of the primary leadframe, the mating contacts of the secondary leadframe being bent out of the contact plane to a second side of the primary leadframe.

8. The electrical connector of claim 1, wherein the contact module includes transmission lines defined along the mating contact of the secondary leadframe to the mounting segments of the secondary leadframe to the corresponding transition contacts of the primary leadframe.

9. The electrical connector of claim 1, wherein the dielectric frame includes a front wall, the mating contacts of the primary leadframe and the mating contacts of the secondary leadframe extending forward from the front wall, the transition contacts of the primary leadframe and the mounting segments of the secondary leadframe extending rearward of the front wall into the dielectric frame.

10. The electrical connector of claim 1, wherein the dielectric frame includes a unitary one piece dielectric body overmolded over the transition contacts of the primary leadframe and the mounting segments of the secondary leadframe.

11. An electrical connector comprising:

a primary leadframe having signal conductors arranged as differential pairs and a carrier holding the signal conductors, the carrier having connecting strips between the signal conductors to hold the relative positions of the signal conductors for overmolding, such connecting strips being configured to be later removed after the signal conductors are overmolded, the signal conductors having transition contacts configured to be encased in a dielectric frame, the signal conductors having residual sections forward of the transition contacts, the connecting strips connecting residual sections of adjacent signal conductors, the residual sections configured to remain after the connecting strips are removed, at least some of the signal conductors having mating contacts extending forward from corresponding residual sections, the mating contacts of the primary leadframe being configured to be electrically connected to corresponding signal contacts of a mating connector; and a secondary leadframe mechanically and electrically connected to the primary leadframe, the secondary leadframe having a carrier configured to be coupled to the carrier of the primary leadframe, the secondary leadframe having mounting segments mechanically and electrically connected to corresponding signal conductors of the primary leadframe, the secondary leadframe having connecting strips between the mounting segments to hold the relative positions of the mounting segments for positioning over the primary leadframe and for overmolding, the connecting strips of the secondary leadframe being configured to be later removed after the mounting segments are overmolded, the secondary leadframe having mating contacts extending from corresponding mounting segments configured to be electrically connected to corresponding signal contacts of the mating connector.

12. The electrical connector of claim 11, wherein the secondary leadframe is welded to the primary leadframe.

13. The electrical connector of claim 11, wherein the mounting segments are terminated to corresponding transition contacts of the primary leadframe and then overmolded by the dielectric frame.

14. The electrical connector of claim 11, wherein one of the signal conductors of each differential pair includes a corresponding mating contact of the primary leadframe and the other signal conductor of the differential pair includes a corresponding mating contact of the secondary leadframe.

15. The electrical connector of claim 11, wherein the signal conductors include mounting contacts extending from the dielectric frame for termination to a circuit board, the transition contacts of the primary leadframe electrically connecting the mounting segments of the secondary leadframe with corresponding mounting contacts of the primary leadframe.

16. The electrical connector of claim 11, wherein the mating contacts of the primary leadframe are aligned with corresponding mating contacts of the secondary leadframe of the same differential pair in rows.

17. The electrical connector of claim 11, wherein the transition contacts are arranged within a contact plane of the primary leadframe, the mating contacts of the primary leadframe being bent out of the contact plane to a first side of the primary leadframe, the mating contacts of the secondary leadframe being bent out of the contact plane to a second side of the primary leadframe.

18. The electrical connector of claim 11, wherein the contact module includes transmission lines defined along the mating contact of the secondary leadframe to the mounting segments of the secondary leadframe to the corresponding transition contacts of the primary leadframe.

19. An electrical connector comprising:

a front housing; and a plurality of contact modules coupled to the front housing, each contact module comprising:

a conductive holder having a front coupled to the front housing and a bottom configured to be mounted to a circuit board, the conductive holder having a chamber including a plurality of channels extending between the front and the bottom;

a contact assembly received in the chamber, the contact assembly comprising a leadframe assembly and a dielectric frame holding the leadframe assembly, the leadframe assembly including a primary leadframe and a secondary leadframe;

the primary leadframe having signal conductors arranged as differential pairs, the signal conductors having transition contacts extending between the front and the bottom, the dielectric frame having frame members supporting corresponding transition contacts, the transition contacts being routed through corresponding channels, the signal conductors including mounting contacts extending from the bottom of the conductive holder for electrical termination to the circuit board, at least some of the signal conductors having mating contacts extending from corresponding transition contacts forward of the front of the conductive holder, the mating contacts of the primary leadframe being configured to be electrically connected to corresponding signal contacts of a mating connector; and the secondary leadframe mechanically and electrically connected to the primary leadframe, the secondary leadframe having mounting segments terminated to corresponding signal conductors of the primary leadframe, the secondary leadframe having mating contacts extending from corresponding mounting segments forward of the front of the conductive holder, the mating contacts of the secondary leadframe being configured to be electrically connected to corresponding signal contacts of the mating connector.

20. The electrical connector of claim 19, wherein the secondary leadframe is welded to the primary leadframe.

* * * * *